US007257919B1

(12) United States Patent
Farley

(10) Patent No.: US 7,257,919 B1
(45) Date of Patent: Aug. 21, 2007

(54) MAGAZINE LOADER

(76) Inventor: Allen D. Farley, 1241 S. 103rd East Ave., Tulsa, OK (US) 74128

( * ) Notice: Subject to any disclaimer, the term of this patent is extended or adjusted under 35 U.S.C. 154(b) by 0 days.

(21) Appl. No.: 11/348,780

(22) Filed: Feb. 8, 2006

(51) Int. Cl.
*F41A 9/83* (2006.01)

(52) U.S. Cl. ..... 42/87; 42/90

(58) Field of Classification Search ..... 42/87, 42/88, 90, 99, 106; 89/45
See application file for complete search history.

(56) References Cited

U.S. PATENT DOCUMENTS

| | | | | | |
|---|---|---|---|---|---|
| 4,464,855 | A | | 8/1984 | Musgrave | |
| 4,689,909 | A | | 9/1987 | Howard | |
| 4,827,651 | A | * | 5/1989 | Conkey | 42/87 |
| 4,872,279 | A | * | 10/1989 | Boat | 42/90 |
| 4,993,180 | A | | 2/1991 | Upchurch | |
| 5,129,173 | A | * | 7/1992 | Kuykendall | 42/90 |
| 5,249,386 | A | | 10/1993 | Switzer | |
| 5,355,606 | A | | 10/1994 | Origoni | |
| 6,189,254 | B1 | | 2/2001 | Steitz | |
| 6,286,243 | B1 | | 9/2001 | Hinton | |
| 6,817,134 | B2 | * | 11/2004 | Newman | 42/87 |

* cited by examiner

*Primary Examiner*—J. Woodrow Eldred
(74) *Attorney, Agent, or Firm*—Willam S. Dorman

(57) ABSTRACT

A loader for a magazine having an upper open end, a lower closed end, a forward vertical side edge and a rear vertical flat side edge, loader having a vertical channel for receiving therein the rear flat edge of the cartridge, the channel being formed by a pair of flat vertical side members spaced apart in parallel relation and having a rear flat edge where it slidably engages the rear flat edge of the magazine, the magazine being made of ferrous metal and the loader being made of non-ferrous material. A vertically extending tab is mounted in the upper portion of the channel and is provided with a downwardly vertically extending plunger mounted at the lower end of the tab for engaging the edge of an uppermost bullet mounted within the magazine. A pair of outwardly and horizontally extending arms are mounted at the lower ends of the flat vertical sides of the loader, the magazine being adapted to receive a plurality of vertically stacked bullets therein, a spring mounted internally in the magazine for urging the bullets upwardly towards the open end of the magazine and against a retaining means which holds the bullets within the magazine whereby, when the user's fingers engage the arms on the loader and urge the loader downwardly against the action of the spring within the magazine, the uppermost bullet is urged away from the retaining means at the top of the magazine and whereby an additional bullet can be inserted into the magazine above the then uppermost bullet after which the loader can be slid upwardly so that the plunger is completely above the last added bullet to permit the last added bullet to be pushed in by hand against the inner flat edge of the magazine, the loader being maintained in sliding contact within the magazine by virtue of a magnet mounted on the rear of the loader.

2 Claims, 3 Drawing Sheets

MAGAZINE LOADER

BACKGROUND OF THE INVENTION

1. Field of the Invention

This invention relates to a bullet loader, more particularly, to a device for reloading bullets into the magazine or clip of a firearm.

2. Prior Art

Many small arms, including both rifles and hand guns are provided with magazines or clips in which the bullets are stored for immediate use. In these firearms, ammunition is placed into an elongated, generally rectangular, container, known as a magazine or clip, which is then fitted into a portion of the firearm approximate to the firing chamber; in the case of a pistol, this clip or magazine can be inserted into the handle of the gun. The magazine or clip is closed on five (5) sides of the rectangular shape and open on one rectangular shaped end. Such magazines or clips are spring loaded and are further provided with retaining members over the open end. Ammunition can be placed into the open end of the magazine, piece by piece, and each piece slips past the retaining members to be held until used. As the magazine is being loaded, each succeeding round of ammunition compresses the spring further and each bullet becomes harder to insert.

When a magazine is fully loaded, it is fitted into a position adjacent to or against the firing chamber of the weapon. Normally, a bolt it used to extract a round and force it into the firing chamber. As each round is fired, the bolt is forced back, picks up the next round and forces the next round into the firing chamber. The force of the spring pushes each round up into its position in the magazine where the bolt can push it into the firing chamber.

The use of a magazine in a firearm provides the convenience of holding a large number of bullets in position for loading in successive order into the firing chamber, thereby allowing for rapid fire of some or all of the loaded bullets. Once the loaded bullets are expended, however, the empty magazine can be quickly removed and a new fully loaded magazine can be quickly inserted into the firearm to resume firing.

Thus, the use of magazines is a convenient and effective method of feeding bullets, in rapid succession, into a weapon's firing chamber. On the other hand, reloading bullets into the spent magazine is known to be problematic. More particularly, the structural design of the magazine requires each bullet to be individually loaded through the top ejection end of the magazine past the retainers and downwardly against the force of the compression spring in order to receive the bullet within the magazine. As each bullet is loaded, in sequence, the compression spring in the magazine becomes progressively compressed until the magazine is fully loaded with bullets. Naturally, the resistance of the compression spring against the downward force of loading the bullets into the magazine becomes greater with each successive bullet loaded into the magazine.

For many years, bullets have been loaded into empty magazines of firearms by hand, using the fingers to force each bullet downwardly against the force of the compression spring and into captured arrangement within the magazine. This process is time consuming, and quite often frustrating, particularly when the resistance of the compression spring begins to increase. This is particularly true on cold days when a person's fingers are numb, or are enclosed in a glove or mitten, or in a situation such as (military combat) when speed of reloading may be of the essence.

A number of devices exist which are adapted to assist the marksman in accomplishing this reloading task. In particular, U.S. Pat. No. 4,464,855 issued to Musgrave on Aug. 14, 1984 teaches a device somewhat useful in solving the above described problem. It teaches a slidably attached apparatus which is provided with a pulling handle and a protrusion which is adapted to push a round of ammunition down into the magazine for insertion of the next round. After each successive round of ammunition is loaded into the magazine, the apparatus must be removed from the magazine and reinserted for the next round. While it does facilitate in solving the problem of reloading, the requirement of removal and reinsertion makes its use somewhat tedious.

U.S. Pat. No. 4,689,909 issued to Howard on Sep. 1, 1987, teaches a device which can be fitted over an ammunition magazine. It is adapted with a spring loaded plunger which, when the device is fitted over the magazine and somehow held in place, is used to push the uppermost round down into the magazine to facilitate sliding in the next round. Then the plunger, which is spring loaded, is depressed and the cartridge is fitted all the way into the back of the magazine. Howard is also somewhat helpful, but difficulties may be encountered in holding the device in place against the magazine.

SUMMARY OF THE INVENTION

This invention involves a loader for a magazine of the type used in firearms such as pistols and rifles. The magazine will generally have an upper open end and a lower closed end, a forward vertical side edge and a rear vertical flat side edge. The loader has a vertical channel for receiving therein the rear flat edge of the cartridge, the channel being formed by a pair of flat vertical side members spaced apart in parallel relation and having a rear flat edge where it slidably engages the rear flat edge of the magazine. The magazine is made of ferrous metal while the loader is made of non-ferrous material. A vertical extending tab is mounted in the upper portion of the channel and is provided with a downwardly vertically extending plunger mounted at the lower end of the tab for engaging the edge of an uppermost bullet mounted within the magazine. In order to hold the loader against the magazine, a magnet is mounted on the back of the loader. A pair of outwardly and horizontally extending arms are mounted at the lower ends of the flat vertical sides of the loader for the purpose of exerting a downward force on the uppermost bullet when two fingers of a user pull down on the arms. The magazine is adapted to receive a plurality of vertically stacked bullets therein, with a spring being mounted internally in said magazine for urging the bullets upwardly towards the open end of said magazine and against a retaining means which holds the bullets within the magazine. Thus, when the user's fingers engage the arms on said loader and urge the loader downwardly against the action of the spring within the magazine, the uppermost bullet is urged downwardly away from the retaining means at the top of the magazine. At this time, an additional bullet can be inserted into the magazine above the then uppermost bullet after which the loader can be slid upwardly so that the plunger is completely above the last added bullet to permit the last added bullet to be pushed in by hand against the inner flat edge of the magazine.

DETAILED DESCRIPTION OF THE PREFERRED EMBODIMENTS

Figure 1:
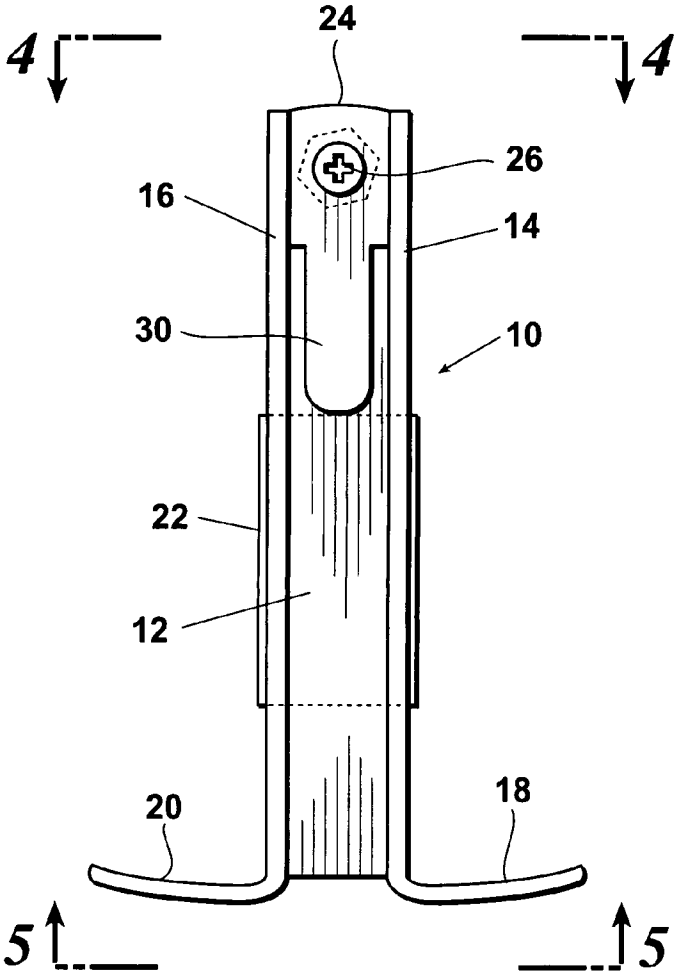
FIG. 1 is a front elevation of the magazine loader of the present invention.
Figure 2:
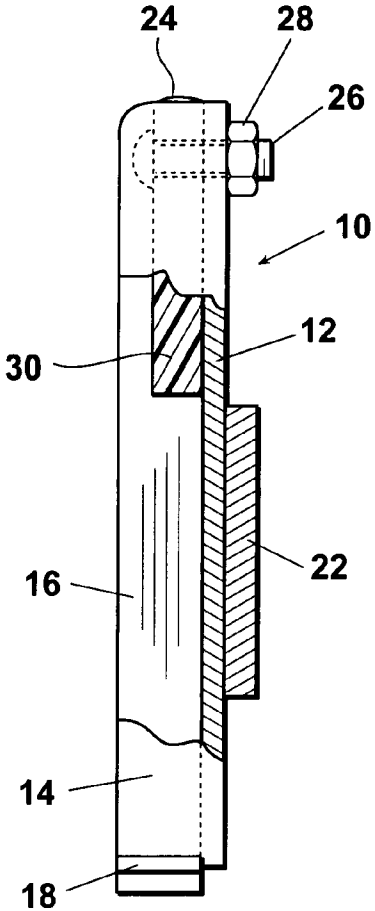
FIG. 2 is a right side elevation of the magazine loader shown in FIG. 1.
Figure 3:
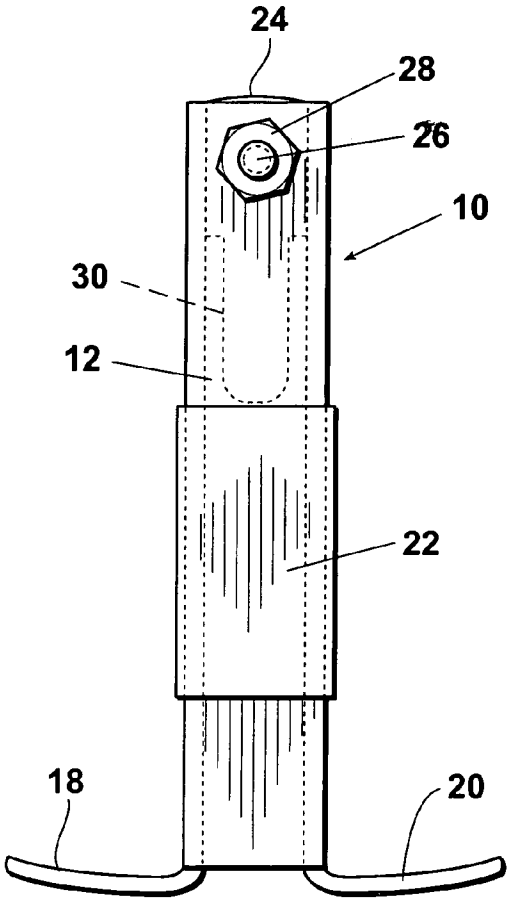
FIG. 3 is a rear elevation of the magazine loader shown in FIG. 1.

Referring to the Drawings in detail, FIG. 1 shows a channel shaped member 10, purely for the sake of comparison purposes, approximately three and one half inches high. The channel 10 is preferably made of aluminum for reasons which will be hereinafter more readily understood. The channel 10 is formed by a flat back portion 12 and a pair of forwardly extending vertical plates 14 and 16 which extend for the full vertical height of the channel member 10. At the bottom of the legs 14 and 16 are arms 18 and 20 which extend horizontally outwardly and which are accessible to the fingers of the shooter's hand. Secured to the back 12 of the channel member 10 is a magnetic plate 22 which is approximately two inches high by one inch wide. The magnetic plate 22 can be attached by any convenient adhesive or welding material which is capable of bonding the magnetic plate 22 to the aluminum back 12.

At the upper end of the channel member 10 is a tab 24 which is held in place by means of a suitable bolt 26 and nut 28 the upper end of the tab 24 is essentially the same width as the distance between the two vertical sides 14 and 16 of the channel member 10. However, starting about three quarters of an inch down from the top, the tab 24 is provided with a plunger 30 which extends downwardly approximately one inch and which is conveniently rounded at the lower end.

Figure 7:
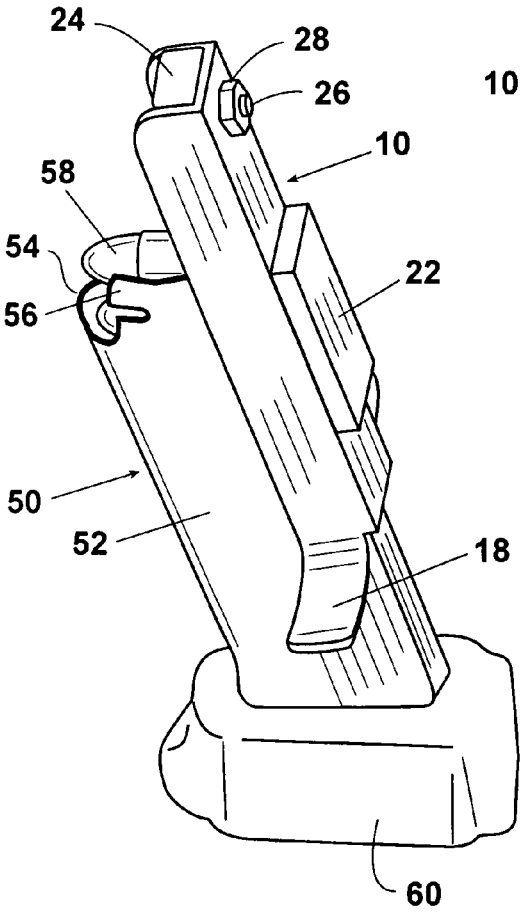
FIG. 7 is a perspective view looking down on the magazine loader from the left rear thereof and mounted on a magazine for loading purposes.
Figure 4:
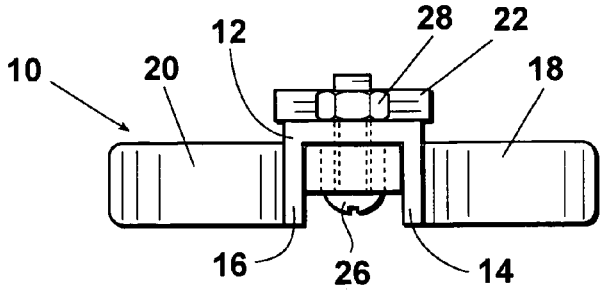
FIG. 4 is a top plan view looking along viewing line 4—4 of FIG. 1.
Figure 6:
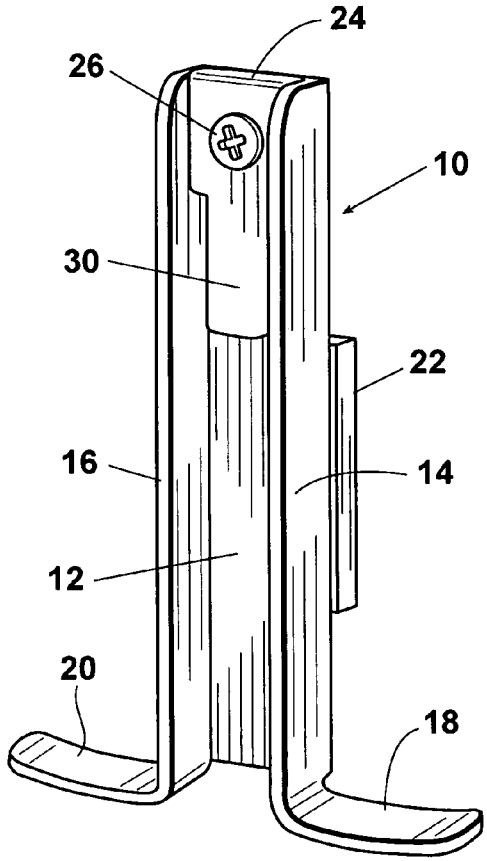
FIG. 6 is a perspective view of the magazine loader shown in FIG. 1.
Figure 5:
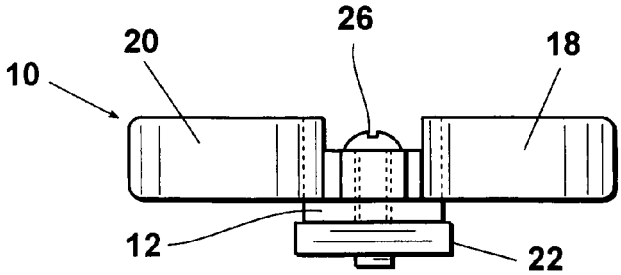
FIG. 5 is a bottom view looking along viewing line 5—5 of FIG. 1.
Figure 8:
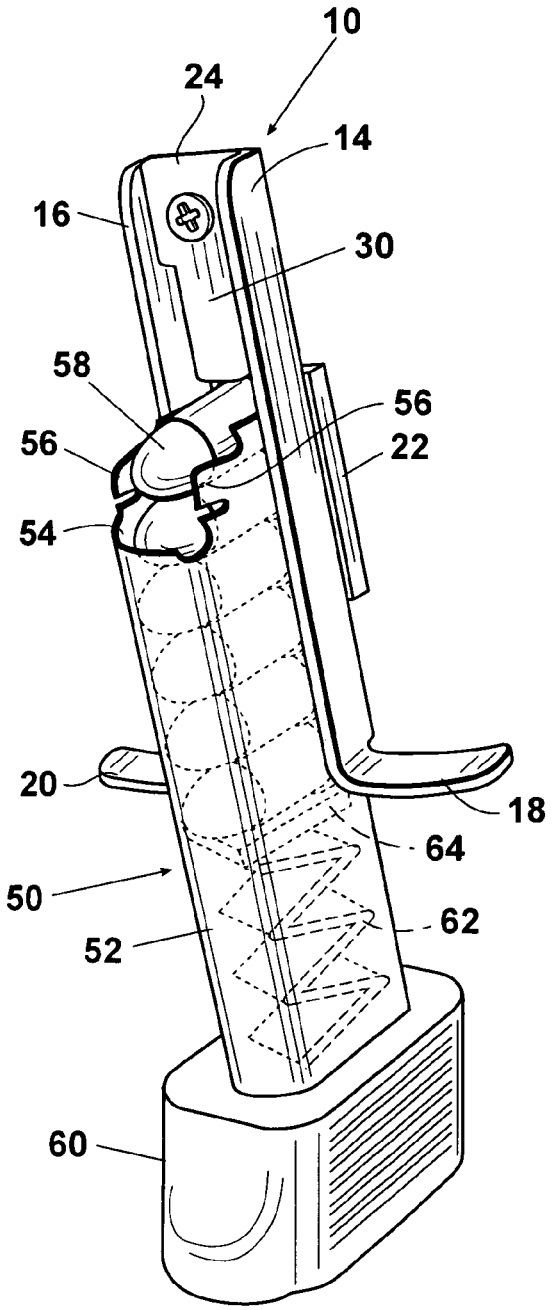
FIG. 8 is a perspective view taken from the front of FIG. 7, showing the magazine loader in its initial stage of adding a bullet to the magazine.

Referring now to FIG. 7, this view shows the loader 10 piggy-backed on a magazine 50 which is designed for use in connection with a 22 caliber pistol, for example, (not shown). The magazine 50 is provided with a vertical substantially rectangular body or casing 52 which is enclosed on all sides except for the top 54 which is open and at which location are provided a pair of retaining members 56 which serve to hold bullets 58 in place when they are inserted into the interior of the casing 52. Although FIG. 8 shows only two bullets 58 at or near the top of the casing 52, it should be understood that there are additional bullets below those visible perhaps to the extent of seven or eight bullets total. Below the lowest bullet there is mounted a spring 62 which engages that bullet through a follower 64 and which extends to the bottom of the chamber 52 to continually urge the bullets 58 in the casing 52 upwardly against the retaining members 56. The bottom of the casing 52 is provided with a base 60 which can conveniently engage the lower end of a pistol handle when the casing 52 is inserted into the handle of a pistol.

In the position shown in FIG. 8, the lower end (plunger) 30 of the tab 24 is shown as engaging the rear end of the uppermost bullet 58 in the chamber 52. It should also be mentioned that the casing 52 of the magazine 50 is provided with a rear flat surface 62 which is adapted to fit into the channel space between the two sides 14 and 16 of the loader 10. It should also be mentioned that the magazine 50 is generally made of ferrous metal so that the magnet 22 will hold the loader 10 conveniently against the back 62 of the magazine 50. Nonetheless, the loader 10 can be moved upwardly or downwardly along the rear of the magazine 50 because of the fit between the back 62 and the channel of the loader 10 itself.

Figure 9:
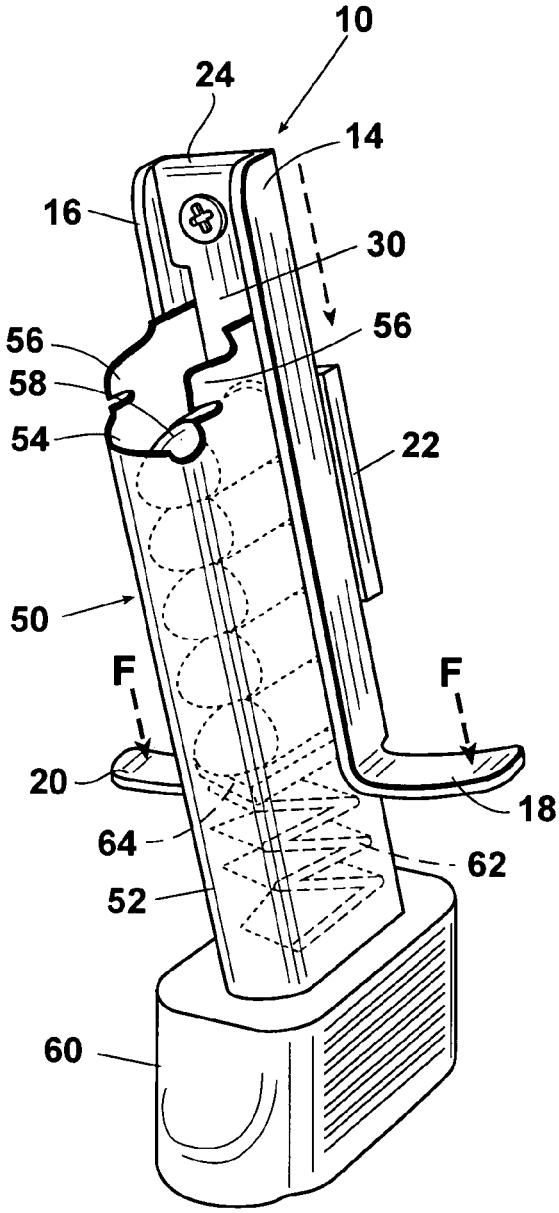
FIG. 9 is a view similar to FIG. 8, but showing the moving downwardly of the magazine loader from the position shown in FIG. 8 by virtue of forces F exhibited on the arms of the loader.

In any event, the view in FIG. 8 shows the lower end of the tab 30 of the plastic insert 24 engaging the rear end of the upper bullet 58. Turning now to FIG. 9, continued downward movement of the loader 10 in relation to FIG. 8 by applying force from the human fingers against the metallic arms 18 and 20 of the loader 10 will cause the bullet 58 to move downwardly where it is essentially out of sight and past the retainers 56. At this point in time another bullet can be inserted just above the bullet 58 shown and pushed backwardly until the rear of the bullet contacts the tab 30. Now the force is removed from the arms 18 and 20 and the uppermost (new) bullet will be held in position by the retainers 56. Continued upper movement of the loader 10 will permit the uppermost bullet to be pushed further in past the lower end of the tab 30 and against the back surface 12 of the loader 10. The loader 10 can then again be actuated to move the lower end of the tab against the rear end of the new bullet and downwardly to approximate conditions shown in FIG. 9, assuming that there is room for another bullet.

OPERATION

Looking at FIGS. 8 and 9, the bullets, such as bullets 58 are loaded into the magazine 52 by placing the loader 10 on the back of the magazine such that the flat rear surface 62 of the magazine is received in the channel of the loader 10, the channel being defined by the back 12 and vertical legs 14 and 16. At this point in time, the plunger 30 of the tab 26 will be bearing against the extreme right-hand end of the bullet 58 adjacent the rim (not shown) thereof. The magnet 22 will be holding the aluminum loader 10 against the ferro-metallic magazine 52, although the flat edge 62 of the magazine can still slide within the channel of the loader 10. The fingers of the user can then engage the arms 18 and 20 of the loader end and exert a force F (See FIG. 9) to urge the loader 10 in a downward direction so that the uppermost bullet 58 is now below the retaining means 56. Now, another bullet can be inserted into the space above the bullet 58 and below the retaining means 56 and pushed rearwardly into that space until the rear end of this new bullet engages the surface of the plunger 30. At this point in time, the force on the arms 18 and 20 is reversed so that the loader 10 can be moved upwardly and the newly added bullet can be pushed back so that it goes against the flat surface 12 beneath the plunger 30.

Whereas the present invention has been described in particular relation to the drawings attached hereto, other and further modifications, apart from those shown as suggested herein, may be made within the spirit and scope of this invention.

What is claimed is:

1. A loader for a magazine having a plurality of vertically stacked bullets therein, a spring mounted internally in said magazine for urging said bullets upwardly towards an open end of said magazine and against a retaining means which holds the bullets within the magazine, a loader having a vertical channel receiving therein a rear flat edge of the cartridge, the channel being formed by a pair of flat vertical side members spaced apart in parallel relation, the magazine being made of ferrous metal and the loader being made of non-ferrous material, a vertically extending tab mounted in the upper portion of the channel and having a downwardly vertically extending plunger mounted at the lower end of the tab for engaging the edge of an uppermost bullet mounted within the magazine, a pair of outwardly and horizontally extending arms mounted at the lower ends of the flat vertical sides of the loader, a magnet mounted on the loader on a side thereof opposite from the rear flat edge so as to hold the loader in sliding engagement with the magazine whereby, when the user's fingers engage the arms on said loader and urge the loader downwardly against the action of the spring within the magazine, the uppermost bullet is urged away from the retaining means at the top of the magazine and whereby an additional bullet can be inserted into the magazine above the then uppermost bullet after which the loader can be slid upwardly so that the plunger is completely above the last added bullet to permit the last added bullet to be pushed in by hand against the inner flat edge of the magazine.

2. A loader for a magazine, said magazine having an upper open end and a lower closed end, a forward vertical side edge and a rear vertical flat side edge, said loader having a vertical channel for receiving therein the rear flat edge of the cartridge, the channel being formed by a pair of flat vertical side members spaced apart in parallel relation and having a rear flat edge where it slidably engages the rear flat edge of the magazine, the magazine being made of ferrous metal and the loader being made of non-ferrous material, a vertically extending tab mounted in the upper portion of the channel and having a downwardly vertically extending plunger mounted at the lower end of the tab for engaging the edge of an uppermost bullet mounted within the magazine, a pair of outwardly and horizontally extending arms mounted at the lower ends of the flat vertical sides of the loader, a magnet mounted on the loader on a side thereof opposite the magazine being adapted to receive a plurality of vertically stacked bullets therein, a spring mounted internally in said magazine for urging said bullets upwardly towards the open end of said magazine and against a retaining means which holds the bullets within the magazine whereby, when the user's fingers engage the arms on said loader and urge the loader downwardly against the action of the spring within the magazine, the uppermost bullet is urged away from the retaining means at the top of the magazine and whereby an additional bullet can be inserted into the magazine above the then uppermost bullet after which the loader can be slid upwardly so that the plunger is completely above the last added bullet to permit the last added bullet to be pushed in by hand against the inner flat edge of the magazine.

* * * * *